US005769066A

United States Patent [19]

Schneider

[11] Patent Number: 5,769,066

[45] Date of Patent: Jun. 23, 1998

[54] GAS POWERED BALL GUN

[75] Inventor: Larrie Schneider, Nokomis, Fla.

[73] Assignee: Ronald Fowler, Bradenton, Fla.

[21] Appl. No.: 831,107

[22] Filed: Apr. 1, 1997

[51] Int. Cl.[6] ..... F41B 11/00; F41B 11/32

[52] U.S. Cl. ..... 124/75

[58] Field of Search ..... 124/63, 71, 73, 124/75, 77

[56] References Cited

U.S. PATENT DOCUMENTS

| | | | |
|---|---|---|---|
| 2,327,653 | 8/1943 | Lisle | 124/73 X |
| 3,465,742 | 9/1969 | Herr | 124/77 |
| 3,572,309 | 3/1971 | DeFreitas | 124/56 |
| 3,868,113 | 2/1975 | Glass et al. | 273/357 |
| 4,112,911 | 9/1978 | Petrick | 124/56 |
| 4,819,609 | 4/1989 | Tippmann | 124/72 |
| 4,936,282 | 6/1990 | Dobbins et al. | 124/74 |
| 5,063,905 | 11/1991 | Farrell | 124/72 |
| 5,161,516 | 11/1992 | Ekstrom | 124/73 |
| 5,267,549 | 12/1993 | Webber | 124/65 |
| 5,285,765 | 2/1994 | Lee | 124/50 |
| 5,333,594 | 8/1994 | Robinson | 124/73 |
| 5,343,849 | 9/1994 | Steer | 124/72 |
| 5,377,655 | 1/1995 | Arad | 124/65 |
| 5,377,656 | 1/1995 | Lewinski et al. | 124/65 |
| 5,396,877 | 3/1995 | Amron | 124/58 |
| 5,431,410 | 7/1995 | Hampton | 273/397 |
| 5,448,984 | 9/1995 | Brovelli | 124/69 |
| 5,494,024 | 2/1996 | Scott | 124/73 |

FOREIGN PATENT DOCUMENTS

| | | | |
|---|---|---|---|
| 77504 | 1/1949 | Czechoslovakia | 124/75 |

*Primary Examiner*—John A. Ricci
*Attorney, Agent, or Firm*—Charles J. Prescott

[57] ABSTRACT

A pressurized gas powered rapid fire ball gun for propelling ball projectiles automatically or semi-automatically. An air chamber formed in a housing which slidably supports an air control spool for longitudinal translation, stores a pressurized gas charge within an internal air reservoir which enhances ball projectile propulsion when simultaneously combined with pressurized gas from a separate source and fed into a firing chamber adjacent the elongated cylindrical barrel at each firing.

3 Claims, 5 Drawing Sheets

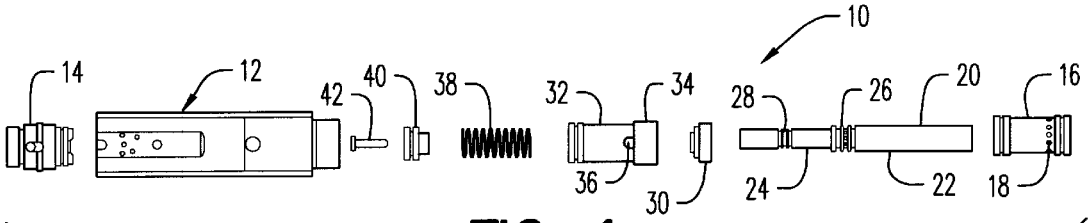
FIG. 1
FIG. 2
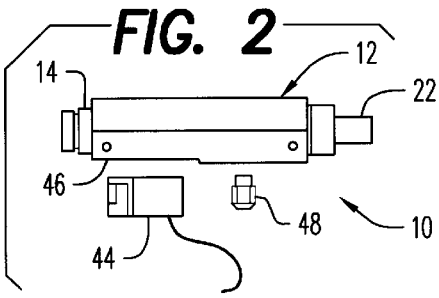
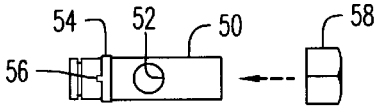
FIG. 3
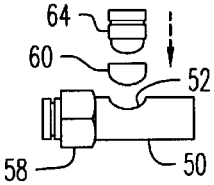
FIG. 4
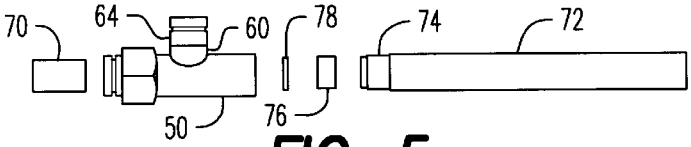
FIG. 5
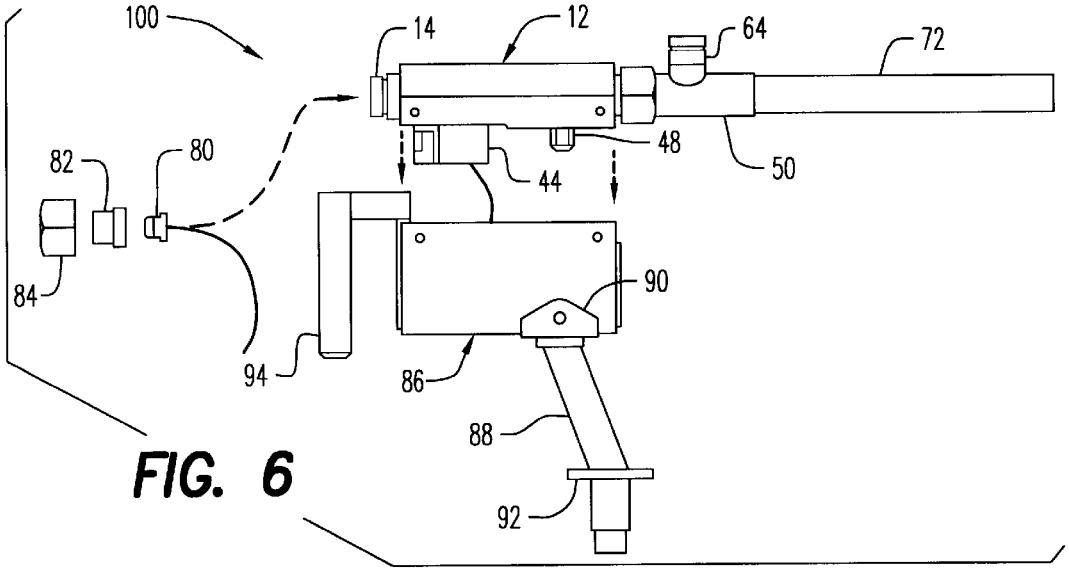
FIG. 6

GAS POWERED BALL GUN

BACKGROUND OF THE INVENTION

1. Scope of Invention

This invention relates generally to pneumatic or pressurized gas ball firing guns of the semi-automatic or automatic firing sequencing type, and more particularly to such a ball gun for propelling ball projectiles similar in size to well known paint balls in an amusement park setting and the like.

2. Prior Art

Semi-automatic and automatic type pneumatic or pressurized gas actuated guns for projecting ball shaped projectiles such as ping-pong balls, paint balls and the like are well known. One such device is disclosed in U.S. Pat. No. 5,063,904 invented by Farrell which teaches a pneumatic gun dependent upon a compressed power spring acting from a cocked position to impact on a primary valve assembly and thereby to release compressed gas from a line source for propelling a spherical projectile from the gun. This arrangement for triggering the firing of a mechanism in releasing a charge of compressed gas from a separate compressed gas source is somewhat complex and, despite that complexity, the efficiency or velocity of projectile propulsion is entirely dependent upon the pressure and volume of compressed gas delivered from the compressed gas source. As the ball projectile is not sealed, further losses in gas pressure at firing are also present.

Steer in U.S. Pat. No. 5,343,849 has also developed a rapid fire ball gun which includes a self-contained pressurized air vessel and an air pump apparently for recharging. A supply of compressible foam balls are loaded in end-to-end relation into an elongated cylindrical barrel and then discharged one at a time, the forward most ball being discharged one at a time.

A number of other devices somewhat more remote in structural and operational nature are disclosed in the following U.S. prior art:

| | |
|---|---|
| Tippmann | 4,819,609 |
| Amron | 5,396,877 |
| Robinson | 5,333,594 |
| Glass et al. | 3,868,113 |
| Dobbins, et al. | 4,936,282 |
| Brovelli | 5,448,984 |
| Ekstrom | 5,161,516 |
| Webber | 5,267,549 |
| Lee | 5,285,765 |
| Hampton | 5,431,410 |
| Arad | 5,377,655 |
| Scott | 5,494,024 |
| Lewinski, et al. | 5,377,656 |
| De Freitas | 3,572,309 |
| Petrick, Sr. | 4,112,911 |

The present invention discloses an automatic or semi-automatic pressurized gas ball gun for propelling spherical paint ball sized, preferably hollow objects and the like. The device holds a supply of ball projectiles which are automatically gravity fed into a chamber positioned between the housing and cylindrical barrel. Pressurized gas from a separate source is fed into the housing and is utilized for accumulation within an air reservoir and for routing throughout passageways in the housing so as to controlledly drive a separate air control spool from its at-rest position to a firing position whereupon the compressed air charge in the air reservoir combines with the line compressed gas pressure from the source to propel each ball projectile.

BRIEF SUMMARY OF THE INVENTION

This invention is directed to a pressurized gas powered rapid fire ball gun for propelling ball projectiles automatically or semi-automatically. An air chamber formed in a housing which slidably supports an air control spool for longitudinal translation, stores a pressurized gas charge which enhances ball projectile propulsion when simultaneously combined with pressurized gas from a separate source and fed into a firing chamber adjacent the elongated cylindrical barrel at each firing.

It is therefore an object of this invention to provide an improved pressurized gas powered ball gun for firing ball projectiles in automatic or semi-automatic fashion.

It is another object of this invention to provide a pressurized gas powered ball gun for firing projectiles which includes an additional air reservoir which holds a pressurized gas charge which combines with pressurized gas from a separate supply for enhanced propulsion of ball projectiles.

It is still another object of this invention to utilize electronic trigger and pressurized gas flow control means for actuation.

It is still another object of this invention to provide a pressurized gas ball gun for firing projectiles with the increased firing efficiency by insuring that virtually all of the pressurized gas utilized to fire each ball projectile is expelled through the barrel and not elsewhere lost.

It is yet another object of this invention to provide a pressurized gas powered ball gun for firing ball projectiles which will operate on very low pressurized gas pressure in the range of as low as about 55 p.s.i.

In accordance with these and other objects which will become apparent hereinafter, the instant invention will now be described with reference to the accompanying drawings.

BRIEF DESCRIPTION OF THE DRAWINGS

FIG. 1 is a bottom plan exploded view of the housing assembly 10 of the present invention.

FIG. 2 is a side elevation exploded view of the assembled housing 10 and electronically controlled air flow solenoid and inlet fitting FIG. 3 is a top plan exploded view of a ball projectile chamber.

FIG. 4 is an side elevation exploded view of FIG. 3 and including a portion of a ball feed mechanism attached to the chamber.

FIG. 5 is a side elevation exploded view of a ball chamber, ball loader tube and barrel.

FIG. 6 is a side elevation exploded view of the entire invention.

DETAILED DESCRIPTION OF THE INVENTION

Figure 9:
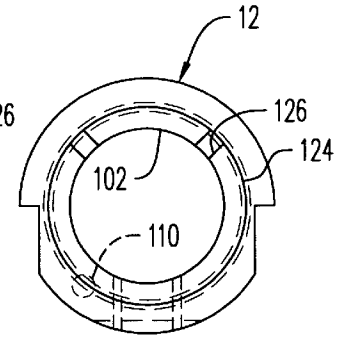
FIG. 9 is a right end elevation view of FIG. 7.
Figure 7:
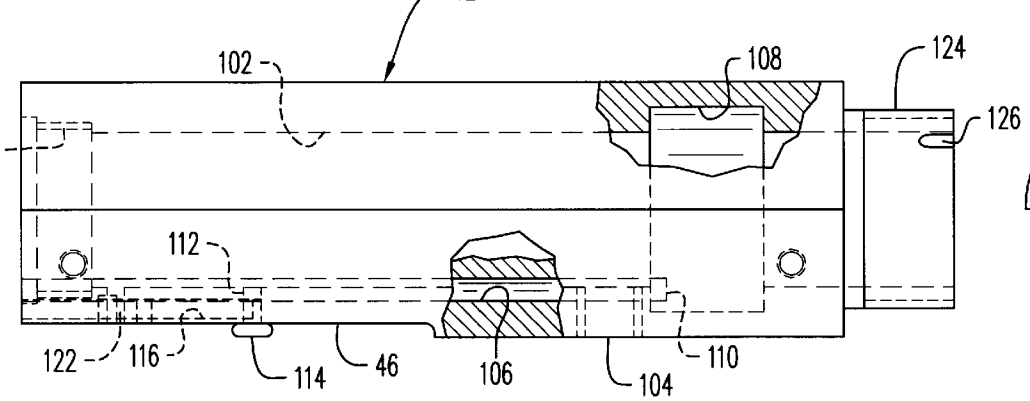
FIG. 7 is a side elevation partially broken view of the housing 12.
Figure 8:
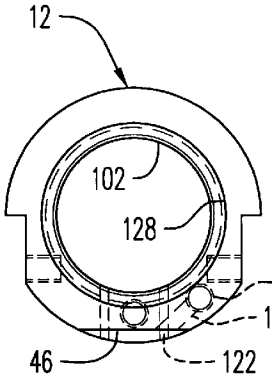
FIG. 8 is a left end elevation view of FIG. 7.
Figure 11:
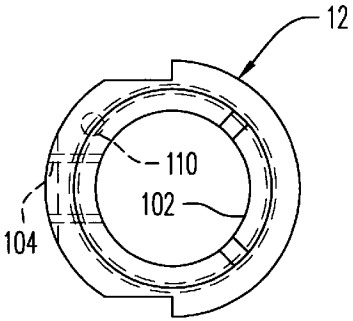
FIG. 11 is a right end elevation view of FIG. 10.
Figure 10:
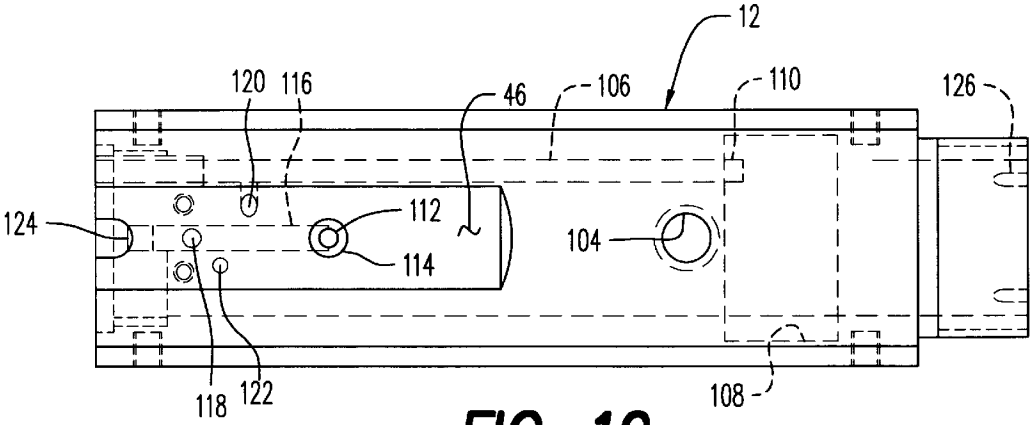
FIG. 10 is a bottom plan view of FIG. 7.

Referring now to the drawings, an exploded view of an air control housing assembly is shown generally at numeral 10. This assembly 10 includes a housing 12 which is shown in detail in FIGS. 7 to 11. The housing 12 is of machined aluminum stock, but could be formed of die cast metal or injection molded plastic material.

The housing 12 is elongated and includes a substantially cylindrical bore 102 formed therethrough. An internal thread 128 is formed at a closed end of the housing 12 which is sized to receive an end plug 14 seen in FIG. 1. The end plug 14 receives an electronic trigger mechanism which includes trigger switch 80, collar 82 and nut 84 as seen in FIG. 6. By this arrangement, this entire end of housing assembly 10 is sealed closed.

An enlarged cylindrical cavity 108 is formed adjacent the other externally threaded end 124 of housing 12. This enlarged cylindrical cavity 108 will form one side of an air reservoir to be described herebelow.

A pressure fitting 48 shown in FIG. 2 theadably engages into internally threaded inlet 104 of housing 12 to provide a means for connecting a separate supply of pressurized gas (not shown) to the housing 12. Pressurized gas which is introduced into inlet 104 is fed by elongated internal passageway 106 into fluid communication with annular cavity 108 at one end 110 of passageway 106 and in an opposite direction to connect with pressure port 120 formed into a flat air control solenoid mounting pad 46.

A bypass port 118 extends from the mounting pad 46 to connect with longitudinal passageway 116 which, in turn, connects with vent 112. A sealing grommet 114 which mateably engages against a closed portion of the mounting surface of air control solenoid 44 provides for unsealed, but inhibited discharge of pressurized gas which is directed into the vent 112. A cylinder port 122 extends from mounting pad 46 directly into the air piston chamber 134 as best seen in FIG. 22.

Figure 14:
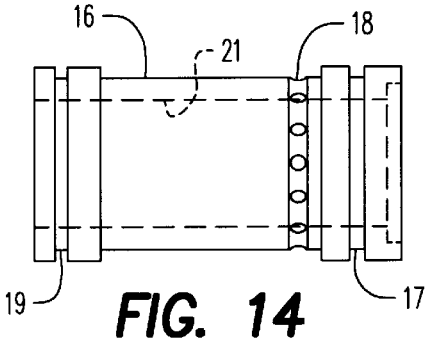
FIG. 14 is a side elevation view of an air control sleeve.
Figure 15:
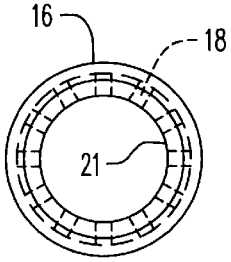
FIG. 15 is an end elevation view of FIG. 14.
Figure 22:
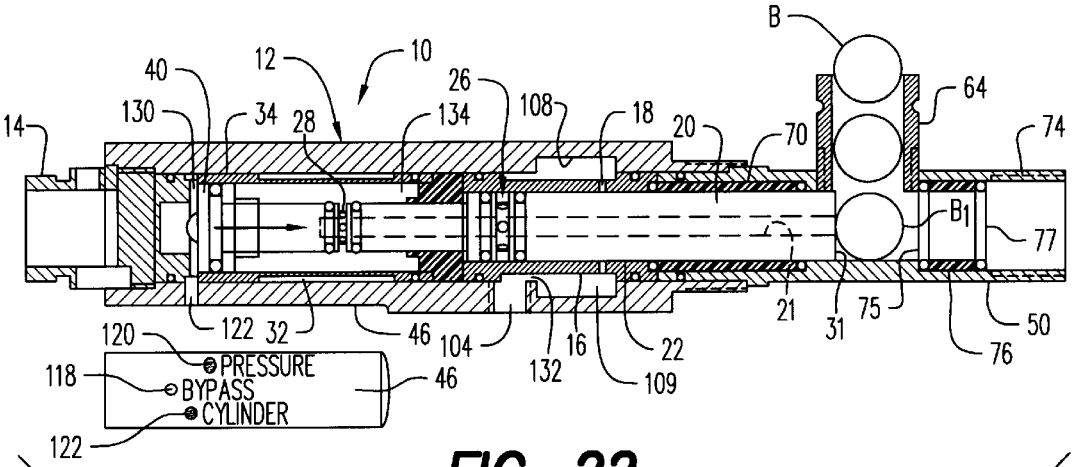
FIG. 22 is a side elevation section view of the housing assembly 10 absent the air control spool return spring, ball chamber and ball loader mechanism showing the arrangement in at at-rest position and showing a bottom plan view of an air control solenoid mounting pad 46.
Figure 23:
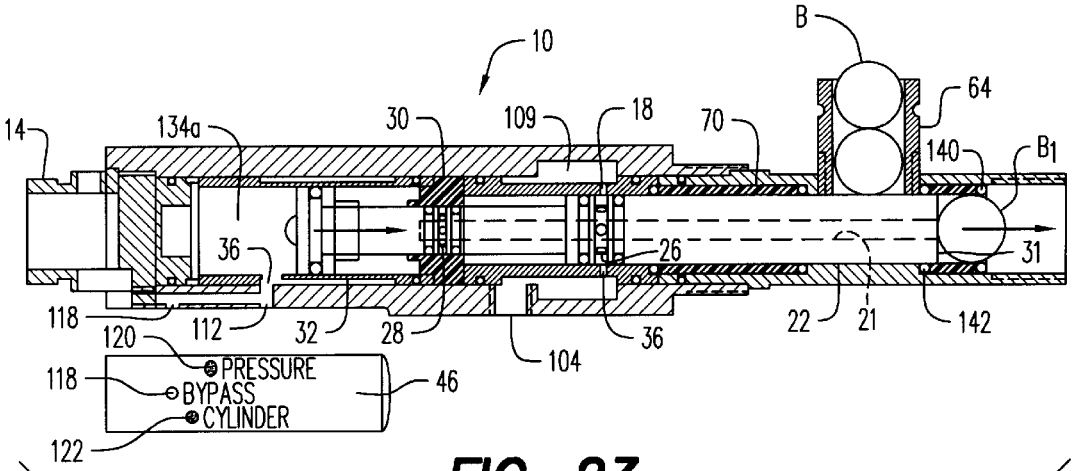
FIG. 23 is a view similar to FIG. 22 showing the mechanism in a firing position.
Figure 24:
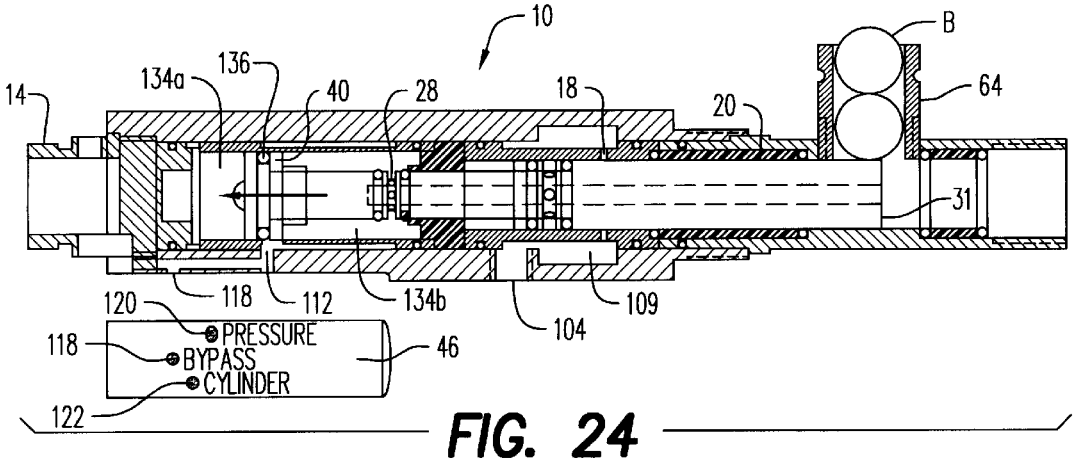
FIG. 24 is a view similar to FIG. 22 showing the mechanism partially returned from firing position.

An air control sleeve 16 is shown separately in FIGS. 14 and 15 and in operable position within housing 12 in FIGS. 22 to 24. The air control sleeve 16 includes a cylindrical longitudinal bore 21 therethrough and radially extending evenly spaced ports 18. Sealing grooves 17 and 19 are provided adjacent each end thereof for receiving o-ring seals as shown in FIGS. 22 to 24. The air control sleeve 16 is positioned stationary within bore 112 of housing 12 so that a central portion of slightly smaller diameter than the end thereof is positioned in alignment with annular cavity 108. By this arrangement, an annular shaped generally cylindrical air reservoir 109 is defined therebetween. Thus, whenever pressurized gas is being introduced into inlet 104, pressurized gas at approximate equal pressure freely flowing through clearance 132 is thereby always available for accumulation within air reservoir 109.

Figure 17:
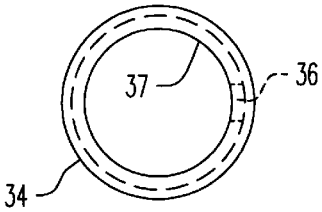
FIG. 17 is an end elevation view of FIG. 16.
Figure 16:
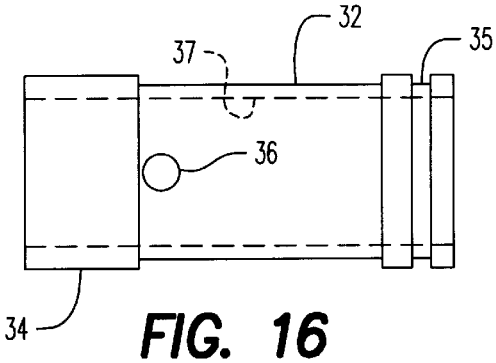
FIG. 16 is a side elevation view of an air piston sleeve.
Figure 19:
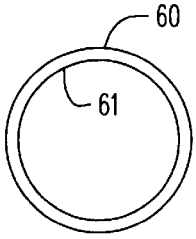
FIG. 19 is a top plan view of FIG. 18.
Figure 21:
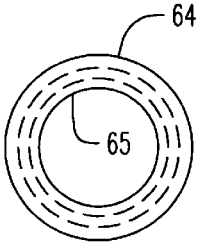
FIG. 21 is a top plan view of FIG. 20.
Figure 18:
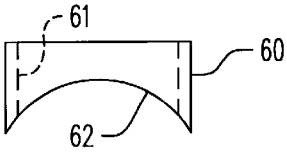
FIG. 18 is a side elevation view of a loader tube spacer.
Figure 20:
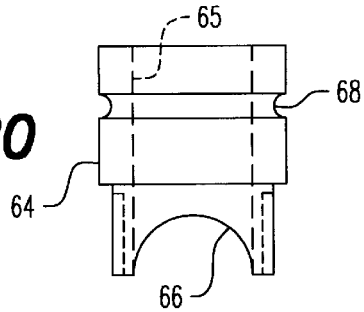
FIG. 20 is a side elevation view of a ball loader tube.

A stationary air piston sleeve 32 as best seen separately in FIGS. 16 and 17 and in exploded view in FIG. 1 and FIGS. 22 to 24 includes a cylindrical bore 37 formed therethrough and an o-ring groove 35 formed adjacent one end thereof and an enlarged cylindrical surface 34 formed at the other end thereof. An air passageway 36 is formed through a central portion of air piston sleeve 32 which extends through to cylindrical bore 37. The air piston sleeve 32 is positioned stationary in close proximity to end plug 14 with an air gap or head space 130 therebetween as best seen in FIG. 22.

Figure 12:
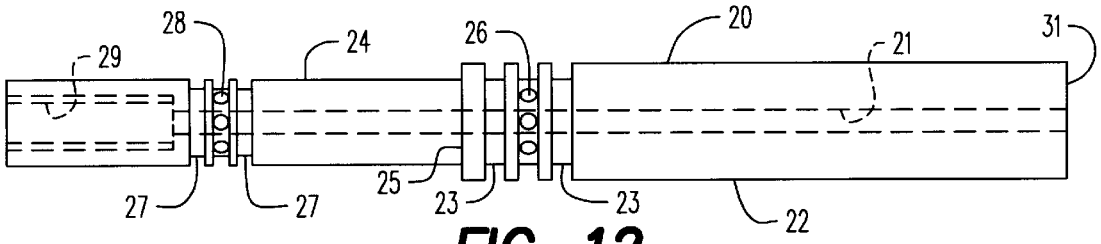
FIG. 12 is a side elevation view of an air control spool.
Figure 13:
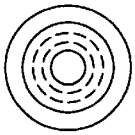
FIG. 13 is an end elevation view of FIG. 12.

The only moveable component within housing assembly 10 is an air control spool 20 as shown separately in FIGS. 12 and 13 and in the exploded view of FIG. 1 and in FIGS. 22 to 24. This air control spool 20 is formed of machined or die injected plastic material such as DELRIN for lightness and durability and is elongated and cylindrical in nature having a longitudinal passageway 21 formed centrally therethrough. About one half of the length of this air control spool 20 defines a continuous cylindrical surface 22 and also defines a maximum diameter of the spool 20. Sealing grooves 23 for receiving sealing o-rings are provided on either side of radially extending ports 26 which extend into passageway 21. A smaller outer cylindrical portion 24 is sized in outside diameter and length to fit and extend within return coil spring 38 shown in FIG. 1 and spring chamber 134 in FIG. 22. A second and smaller set of radially extending ports 28 having sealing grooves 27 on either side thereof for receiving o-rings are positioned at a mid point of the smaller cylindrical surface 24. An internal thread 29 sealingly receives threaded fastener 42 shown in FIG. 1 which retains an air controlled spool piston 40 connected to the corresponding end of the air control spool 20.

As seen in FIGS. 1 and 22 to 24, the air control spool 20 is positioned and is somewhat coextensive within housing 12. At one end of housing 12, the air control spool piston 40 slidably engages in sealing fashion within the cylindrical bore 37 of the air piston sleeve 32 and cylindrical surface 22 slidably engages within cylindrical bore 21 of the air control sleeve 16 with the o-rings within sealing grooves 23 forming a gas seal on either side of radial ports 26.

A ball chamber 50 as seen in FIGS. 3, 4, 25 and 26 is connected onto the open end of housing 12 and is self-aligning with tab 56 interengaging with one notch 126 of housing 12. A threaded nut 58 retains this arrangement as best seen in FIGS. 22 to 24. An air control seal spacer 70 fitted within cylindrical bore 55 slidably engages around cylindrical surface 22 of the air control spool 20. O-rings disposed at each end of the air control seal spacer 70 insure sealed slidability of the mating surfaces therebetween.

Figure 25:
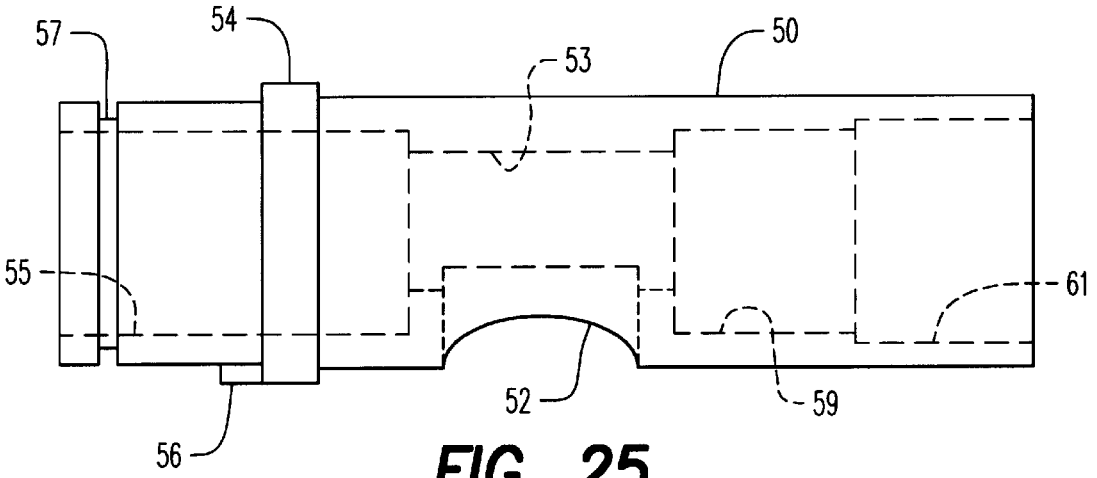
FIG. 25 is a side elevation view of the ball chamber.
Figure 26:
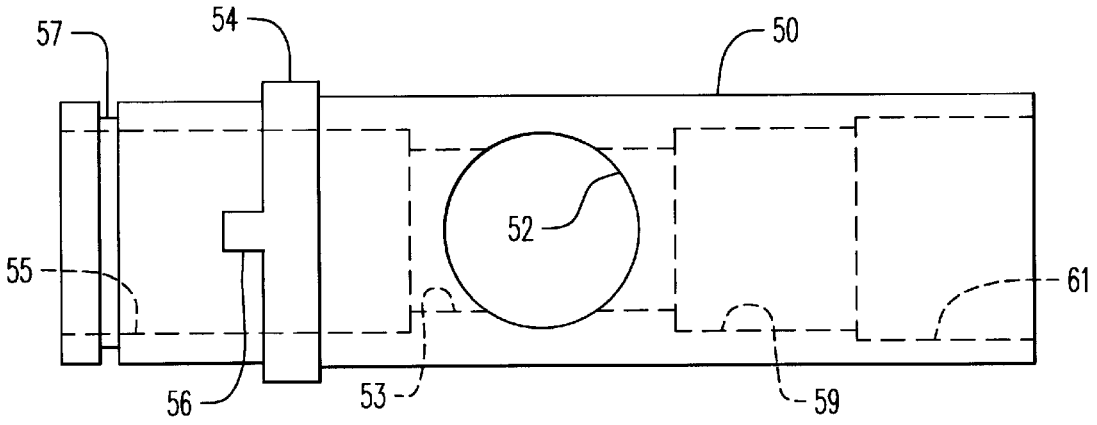
FIG. 26 is a bottom plan view of FIG. 25.

A ball loader tube 64 and spacer 60 are connected as best seen in FIGS. 22 to 24 to a circular aperture 52 formed centrally through a side wall of the chamber 50 and extend into longitudinal central bore 53 as seen in FIGS. 25 and 26. The inner bore 65 of the ball loader tube 64 is sized to allow ball projectiles B to freely drop downwardly by gravity therethrough. By this arrangement, a plurality of ball projectiles B may be stored in ready-to-load position within the ball loader tube 64 and an upward tubular extension thereof (not shown). By this arrangement, a ball projectile B1 is always in position within the central cylindrical bore 53 of chamber 50 in ready-to-fire position.

The barrel 72 is permanently and sealably fitted at surface 74 into cylindrical bore 61 of chamber 50. Obviously, the barrel 72 is sized in inside diameter to minimize clearance with ball projectile B and yet allow each ball projectile B to be efficiently fired therethrough. Clearance is typically in the range of 0.012".

As previously briefly discussed, an electronically regulated air control solenoid 44 is connected onto mounting pad 46 of housing 12. As will be explained in more detail below, this air control solenoid 44 directs air flow between passageways 118, 120 and 122 formed into mounting pad 46. This air control solenoid 44 is commercially available under the trademark MAC, Model No. 35A-BOO-DACE-1BA manufactured in Wixom, Mich. Liege, Belgium and Auckland, New Zealand. The electronic trigger actuator 80 is supplied by McMaster-Carr, part No. 7397K25.

The entire air control housing assembly 10 and barrel 72 are connected to and supported on a swivel mount base shown generally at 86 in FIG. 6. This swivel base 86 includes a support tube 88 connected at 90 with mounting flange 92 and handle 94 also being provided to facilitate mounting and use in an amusement theme park or ride.

MODE OF OPERATION

Referring particularly to FIGS. 22 to 24, the mode of operation during each firing sequence is there shown. Note that the return spring 38 shown in FIG. 1 is deleted for clarity. With pressurized gas from a separate source (not shown) connected to inlet 104, pressurized gas enters into air reservoir 109 and is retained in sealed relationship between cavity 108 and the outer surfaces of the air control sleeve 16 and surface 22 of the air control spool 20.

As seen in FIG. 22, the housing assembly 10 is shown at the beginning of a firing sequence. One ball projectile B1 has been fed by gravity into firing position with the distal end 31 of the air control spool 20 in contact therewith. When the electronic trigger 80 shown in FIG. 6 is actuated, the air control solenoid 44, which continuously receives pressurized gas thereinto through pressure port 120 via longitudinal passageway 106 in FIG. 7 as previously described, transfers air pressure into the cylinder port 122 which immediately delivers pressurized gas into head space 130 acting against the head of the air control spool piston 40 to begin to move the entire air control spool 20 in the direction of the arrow.

As seen in FIG. 23, at the instant of firing, the ball projectile B1 in firing position, has been urged by the distal end 31 of the air control spool 20 into a restrained sealing arrangement with o-ring 140. Note that o-ring 142 is sealingly engaged around the distal portion of surface 22. It is at this momentary firing position that the air reservoir 109 which has previously been charged with pressurized gas equal in pressure to that of line pressure entering into inlet 104 is vented into radial vents 26 of the air control spool 20 which momentarily align with the radial vents 18 of the air control spool 16. In this position, the longitudinal bore 21 being previously sealed, receives the entire accumulated gas charge within gas reservoir 109, along with the pressurized gas available at inlet 104 from the pressurized gas source. This entire pressurized gas charge is forced against the ball projectile B1 to propel it from the barrel 72.

Note that, because the distal end of the air control spool 20 is sealed within oaring 142 and the ball projectile B1 is sealed against o-ring 140, virtually all of this combined pressurized gas charge is utilized efficiently to propel the ball projectile B1 and is discharged from the distal end of barrel 72.

In FIG. 24, the air control spool 20 is being returned to the at-rest position in the direction of the arrow. The air control solenoid 44 has additionally delivered pressurized gas into bypass port 118 which provides pressurized gas into spring chamber portion 134*a* to somewhat cushion the movement of the air control spool 20, by sealing this air chamber portion 134*a* as o-ring 136 passes by and seals off port 36 of the air piston sleeve 32.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A pressurized gas powered ball gun for firing ball projectiles comprising:

an elongated housing connectable to a pressurized gas source and having a cylindrical bore there through extending substantially between a closed and an open end of said housing;

an air control sleeve held from substantial relative longitudinal movement within said bore, said bore having an enlarged portion which, in cooperation with an outer surface of said air control sleeve, defines a sealed air reservoir around said air control sleeve;

an elongated air control spool having a longitudinal air passage formed there-through from a closed to an open end thereof, said air control spool slidably positioned for relative longitudinal movement within said air control sleeve between a biased at-rest position wherein said air control spool closed end is positioned immediately adjacent said housing closed end, and a firing position;

an air passage formed through said air control sleeve in fluid communication with said air reservoir whereby said air reservoir is filled with pressurized gas when the pressurized gas source is connected to said housing;

a chamber connected to and extending coaxially from said housing open end for receiving and sealingly positioning one ball projectile at a time within said chamber;

a cylindrical barrel connected to and extending coaxially from said open end;

means connected to said chamber for repeatedly automatically feeding one ball projectile at a time into said chamber;

gas control means connected to said housing for selectively directing pressurized gas from the pressurized gas source to between said air control spool closed end and said housing closed end to move said air control spool from the at-rest position to the firing position each time a trigger means operably activates said gas control means whereby the ball projectile in said chamber is moved by said air control spool second end into a sealed firing position of the ball projectile;

said air control spool including sealing and radial air passage means positioned at a mid portion thereof for releasing pressurized gas from said air reservoir and from the pressurized gas source into said air passage means into said longitudinal air passage in said air control spool to propel the ball projectile as said air control spool reaches the firing position.

2. A pressurized gas powered ball gun for firing ball projectiles comprising:

housing means for operable connection to a pressurized gas source;

spool means held for slidable longitudinal translation within said housing means;

air reservoir means between said housing means and said spool means for sealably accumulating and holding a charge of the pressurized gas;

chamber means connected coaxially to an open end of said housing means for receiving and facilitating sealed positioning of one ball projectile at a time;

barrel means connected coaxially to an open end of said chamber means for guiding a propelled ball projectile;

ball projectile feed means connected to said chamber means for holding a quantity of ball projectiles and for automatically feeding one ball projectile at a time into said chamber means;

gas control means connected to said housing means for selectively directing pressurized gas from the pressurized gas source to between a closed end of said spool means and an adjacent closed end of said housing means whereby said spool means is moved by pressurized gas from a biased at-rest position to a firing position and the ball projectile in said chamber means is simultaneously therewith moved axially by contact with an open end of said spool means into a gas-sealed firing position within said chamber means;

sealed air passage means positioned between a mid portion of said housing means and said spool means and extending centrally along said spool means to said open end of said spool means for releasing the pressurized gas charge in said air reservoir means, along with pressurized gas from the pressurized gas source, into said air passage means to propel the ball projectile in said chamber means when said spool means reaches the firing position.

3. A pressurized gas powered ball gun for firing ball projectiles comprising:

an elongated housing having a centrally positioned access port for connection to a pressurized gas source and also having a substantially cylindrical bore therethrough extending substantially between a closed and an open end of said housing, said access port being in fluid communication with a substantially cylindrical radially enlarged bore portion of said bore;

an air control sleeve held from substantial relative longitudinal movement within said bore and having an outer surface which, in cooperation with said enlarged bore portion, defines a sealed air reservoir around said air control sleeve;

an elongated air control spool having a central longitudinal air passage formed therethrough extending from a closed to an open end thereof, said air control spool slidably positioned for relative longitudinal movement within said air control sleeve between a biased at-rest position wherein said air control spool closed end is positioned immediately adjacent said housing closed end and a firing position;

an air passage formed through said air control sleeve in fluid communication between said air reservoir and said access port whereby said air reservoir is filled with pressurized gas when the pressurized gas source is connected to said housing;

a chamber connected to and extending coaxially from said housing open end and having a cylindrical bore formed there through sized in diameter to sealably receive one ball projectile at a time;

a cylindrical barrel connected to and extending coaxially from said chamber open end;

a ball projectile loading tube connected to an aperture formed through a wall of said chamber for repeatedly automatically feeding one ball projectile at a time into said chamber prior to each firing of said ball gun;

gas control means connected to said housing for selectively directing pressurized gas from said access port to between said air control spool closed end and said housing closed end to move said air control spool from the at-rest position to the firing position each time a trigger means operably activates said gas control means whereby the ball projectile in said chamber is moved by said air control spool second end into a sealed firing position of the ball projectile;

said air control spool including a sealing and radial air passage means positioned at a mid portion thereof for automatically releasing pressurized gas from within said air reservoir, and substantially simultaneously from the pressurized gas source into said longitudinal air passage in said air control spool to propel the ball projectile as said air control spool reaches the firing position.

* * * * *